United States Patent [19]

Garries et al.

[11] Patent Number: 4,920,709

[45] Date of Patent: May 1, 1990

[54] J-CHANNEL MEMBER FOR SIDING

[75] Inventors: Ray W. Garries, Conneaut; Edward H. Burke, Jefferson; Kevin D. Mueller, Conneaut, all of Ohio; Joseph D. Leone, Erie, Pa.

[73] Assignee: Webb Mfg., Inc., Conneaut, Ohio

[21] Appl. No.: 336,035

[22] Filed: Apr. 11, 1989

[51] Int. Cl.[5] ..... E04G 15/02

[52] U.S. Cl. ..... 52/85; 52/211; 52/314; 52/631; 52/543; 52/556; 52/717.1

[58] Field of Search ..... 52/58-60, 52/204, 208, 85, 86, 716.1, 717.1, 718.1, 543, 211, 631; 49/462

[56] References Cited

U.S. PATENT DOCUMENTS

| | | | |
|---|---|---|---|
| 1,520,782 | 12/1924 | Swiney | 52/211 |
| 1,739,943 | 12/1929 | Bolender | 52/255 |
| 2,311,345 | 2/1943 | Mitchell | 52/255 |
| 2,663,390 | 12/1953 | Dordel | 52/211 |
| 3,008,273 | 11/1961 | Widin | 52/717.1 |

FOREIGN PATENT DOCUMENTS

| | | | |
|---|---|---|---|
| 2273921 | 1/1976 | France | 52/256 |

*Primary Examiner*—James L. Ridgill, Jr.

*Attorney, Agent, or Firm*—Renner, Otto, Boisselle & Sklar

[57] ABSTRACT

J-channel member comprises a relatively rigid plastic back leg and channel bottom wall, with spaced apart slits along the length of the back leg to permit bending of the bottom wall around a radiused opening, and a relatively flexible plastic front leg which permits stretching of the front leg during such bending of the bottom wall while leaving the front leg intact. At the outer end of the front leg is an inturned annular lip which is urged radially inwardly into engagement with the trimmed ends of vinyl or aluminum siding received in the channel to help hold the siding down and enhance the overall appearance of the joint.

28 Claims, 2 Drawing Sheets

J-CHANNEL MEMBER FOR SIDING

BACKGROUND OF THE INVENTION

This invention relates generally, as indicated, to a J-channel member for use in masking or blending siding made, for example, of vinyl or aluminum, around openings in a building structure for windows, doors, louvers or similar such inserts.

When installing vinyl or aluminum siding and the like, the siding must be trimmed around all the window, door or louver frames and the like to leave a slight gap or clearance, for example, approximately ⅜ inch clearance therearound, for expansion and contraction of the siding. Normally this gap is concealed by a conventional J-channel which is put up around the frames before the siding is installed.

As long as the framed openings have substantially straight sides, it is a relatively simple matter to fit a conventional J-channel around the openings. However, if the openings are radiused as, for example, in the case of half round or round windows or louvers, it is much more difficult to fit a conventional J-channel around the openings, in that substantial cutting of both the front and back legs of the J-channel and subsequent caulking of the resulting gaps in the front leg after the J-channel has been fitted around the radiused openings are required.

SUMMARY OF THE INVENTION

With the foregoing in mind, it is a principal object of this invention to provide an improved J-channel member which has excellent formability around radiused openings.

Another object is to provide such a J-channel member which does not require any cutting of the front and back legs of the J-channel during installation around radiused openings.

Still another object is to provide such a J-channel member that does not have any gaps requiring caulking in the front leg after installation around radiused openings.

Yet another object is to provide such a J-channel member which securely hugs the trimmed ends of the siding to aid in holding the siding down and enhance the overall appearance.

A further object is to provide such a J-channel member which insures a snug fit against the exterior sheathing of a building structure and the nailing flange of any window, door or louver frames installed therein.

Yet another object is to provide such a J-channel member which relieves stresses caused by expansion and contraction of the J-channel member due to temperature changes.

These and other objects of the present invention may be achieved utilizing a J-channel member having a relatively rigid back leg and channel bottom wall, with plural spaced apart slits along the length of the back leg, and a relatively flexible front leg which permits the J-channel member to be relatively easily fitted around a radiused opening while leaving the front leg intact. The slits in the back leg divide the back leg into a plurality of nailing tabs, each of which may have a relatively short length, for example, of approximately 2 inches, for better formability. Also, suitable nailing slots may be provided in each nailing tab to relieve stresses caused by expansion and contraction.

Preferably, the J-channel member of the present invention is made out of a one piece plastic extrusion utilizing a relatively rigid plastic material for the back leg and channel bottom wall and a relatively flexible plastic material for the front leg. Also, the nailing tabs which comprise the rigid back leg of the J-channel member are desirably stepped at one or more places along their height to provide a relatively snug fit against the exterior sheathing of the building structure and any nailing flanges on the respective window, door or louver frames around which the J-channel member is fitted. Furthermore, the front leg is desirably provided with a slight inward draft relative to the back leg, and an inturned annular lip at the outermost end thereof, whereby when the J-channel member is fitted around a radiused opening, there is a natural tendency for the front leg to bend inwardly to cause the inturned annular lip to press against the portion of the siding received in the channel member. This helps hold the siding down and enhances the overall appearance of the joint. Also, such inward flexing of the front leg allows one J-channel member profile to fit different siding thicknesses.

To the accomplishment of the foregoing and related ends, the invention, then, comprises the features hereinafter fully described and particularly pointed out in the claims, the following description and the annexed drawings setting forth in detail a certain illustrative embodiment of the invention, this being indicative, however, of but one of the various ways in which the principles of the invention may be employed.

DETAILED DESCRIPTION OF THE PREFERRED EMBODIMENT

Figure 2:
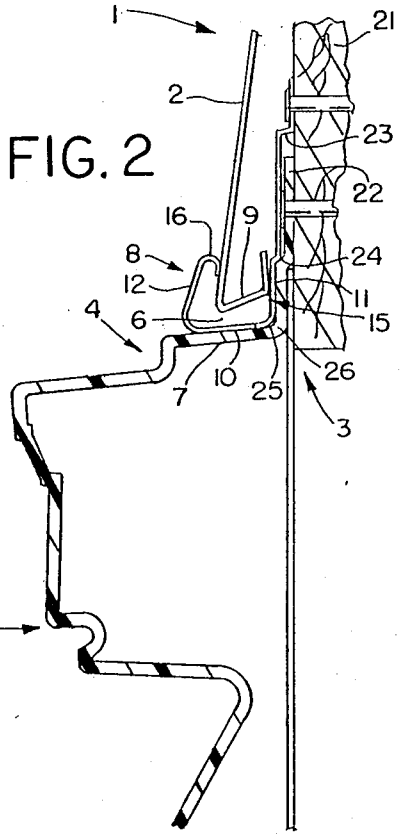
FIG. 2 is an enlarged fragmentary vertical section through the building structure of FIG. 1 taken generally along the plane of the line 2—2 thereof.
Figure 1:
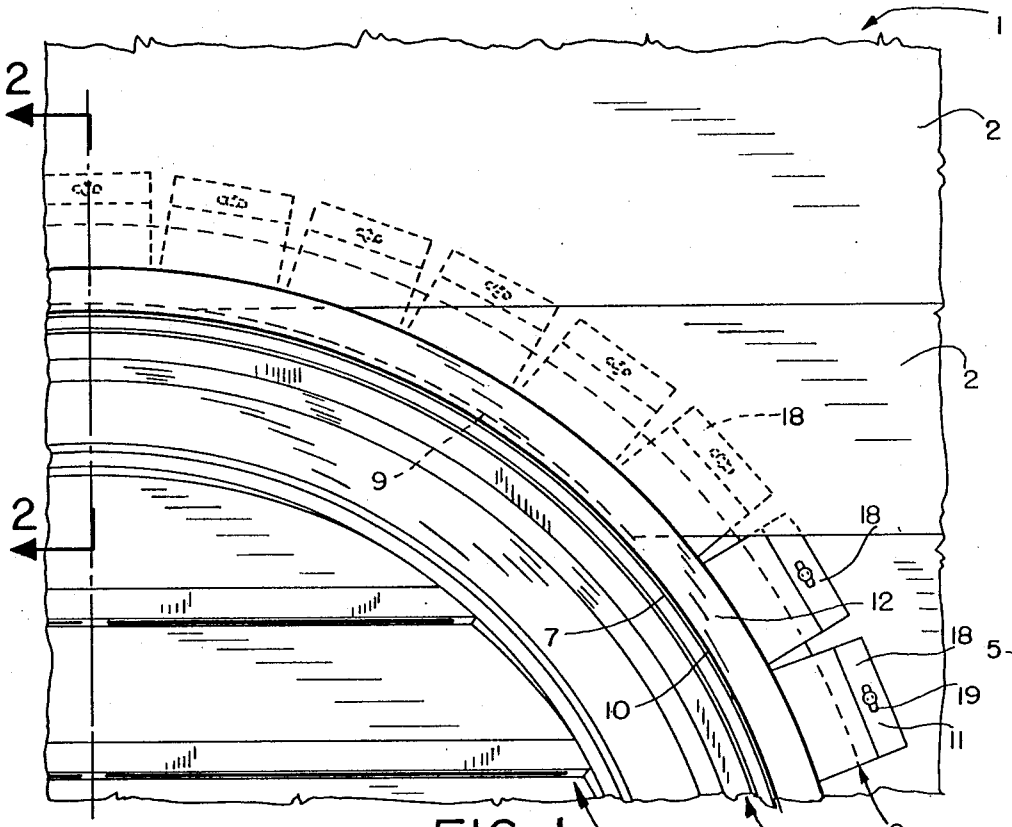
FIG. 1 is a schematic fragmentary front elevation view of a preferred form of J-channel member in accordance with this invention shown fitted around a frame surrounding a radiused opening in a building structure for use in joining vinyl or aluminum siding to such frame.

Referring now in detail to the drawings, and initially to FIGS. 1 and 2, there is schematically shown a portion of a building structure 1 having vinyl or aluminum siding 2 or the like covering the exterior surface thereof. The siding 2 is shown extending up to a radiused opening 3 in the building structure which is surrounded by a frame 4 of a round or half round window or louver 5 or other such insert. The siding 2 is trimmed where necessary to leave a small gap or clearance 6, for example, of approximately ⅜ inch around the adjacent outwardly protruding frame portion 7 to provide for expansion and contraction of the siding caused by temperature changes. Fitted around the frame portion 7 is a J-channel member 8 in accordance with this invention which receives the trimmed ends 9 of the siding 2 to conceal the gap 6 and join the siding 2 to the frame 4 as described hereafter.

Figure 3:
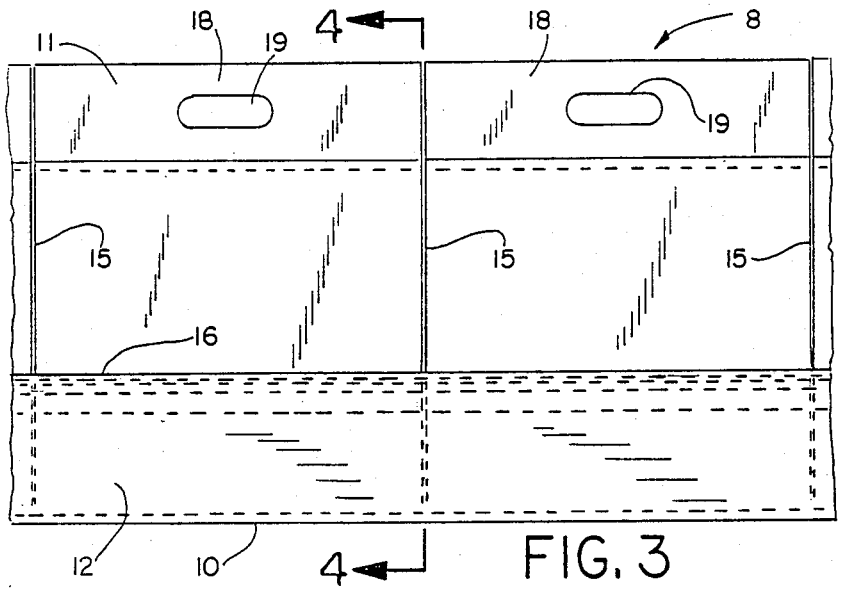
FIG. 3 is an enlarged front elevation view of a portion of the J-channel member of the present invention prior to installation.
Figure 4:
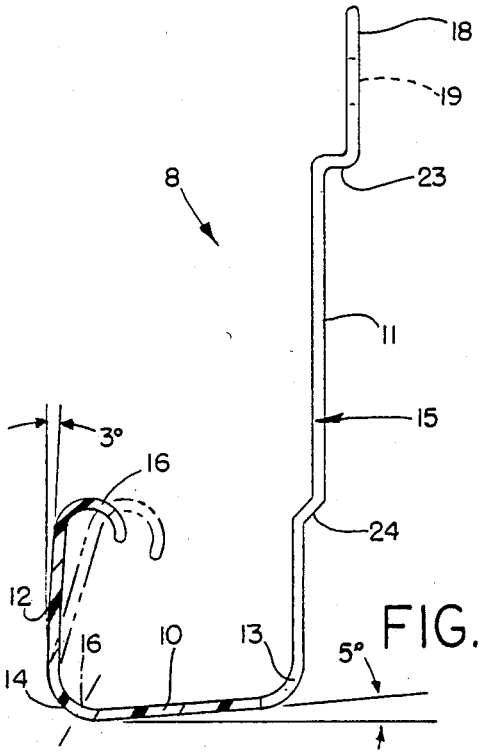
FIG. 4 is an enlarged fragmentary vertical section through the J-channel member of FIG. 3 taken generally along the plane of the line 4—4 thereof.

Referring further to FIGS. 1 and 2 and also to FIGS. 3 and 4, the J-channel member 8 includes a generally flat bottom wall 10 having a pair of upstanding legs 11 and 12 extending along opposite edges thereof. One of the legs 11, hereafter referred to as the back leg, is desirably substantially longer than the other leg 12, hereafter referred to as the front leg.

J-channel member 8 preferably comprises a one-piece plastic extrusion made for example of a suitable ultraviolet and weather-resistant vinyl for long life, and cut to any desired length. Both the bottom wall 10 and back leg 11 are made of a relatively rigid plastic material for needed support. Also, the back leg 11 is desirably slitted, for example, approximately every 2 inches along the entire length thereof to permit the J-channel member to be easily fitted around radiuses. The slits 15 extend the full height of the back leg 11 and also preferably into the channel bottom wall 10 to the extent of the rounded edge 13 which joins the back leg 11 and bottom wall 10 as shown in FIG. 4.

The front leg 12, on the other hand, is desirably made of a relatively flexible plastic material having a durometer hardness, for example, of approximately 85, to permit stretching of the front leg 12 during fitting of the J-channel member 8 around a radius and flexing of the front leg 12 so that the trimmed ends 9 of the siding 2 can be inserted into the J-channel member 8 after installation without having to slit or otherwise cut the front leg 12. A rounded edge 14 also joins the front leg 12 and bottom wall 10. The entire front leg 12 is flexible beginning at approximately the midpoint 16 of the rounded edge 14 as schematically shown in FIG. 4, whereas the bottom wall 10 up to such midpoint 16 and the entire back leg 11 are relatively rigid. Extending the full length of the outer end of the front leg 12 is an inturned annular lip 16 which presses against the front face of the siding 2 after the siding end portions 9 have been inserted into the J-channel member 8 as schematically shown in FIGS. 1 and 2.

The multiple slits 15 in the back leg 11 divide the back leg 11 into a series of closely spaced nailing tabs 18 which provide a plurality of attachment points for the J-channel member 8 for better formability. Also, each of the nailing tabs 18 is desirably provided with an elongated slot 19 adjacent the outer end thereof for nailing to relieve any stresses caused by expansion or contraction of the J-channel member due to temperature changes.

Furthermore, the back leg 11 is desirably stepped at one or more places along its vertical height to provide a relatively snug fit against the exterior sheathing 21 and any nailing flange 22 of the window, door or louver frame 4 located behind the back leg 11 as further shown in FIG. 2. Also the nailing slots 19 in the nailing tabs 18 are located radially outwardly of the nailing flange 22 of any such door, window or louver frame 4 as further shown in FIG. 2 to allow uninhibited movement of such frame 4.

The J-channel member 8 is installed around all such frames 4 before the siding 2 is put up. During such installation of the J-channel member 8, a ¼ inch bead of sealant 25 is desirably applied around the perimeter of the frame 4 in the corner 26 which receives the rounded edge 13 of the J-channel member as shown in FIG. 2 to ensure that the slits 15 in the J-channel member are sealed at this corner. Then, the J-channel member 8 is nailed in place using roofing nails and cut to the desired length.

When the bottom wall 10 of the J-channel member 8 is relatively straight, both the front and back legs 12 and 11 are generally perpendicular to the bottom wall and generally parallel to each other as schematically shown in FIGS. 3 and 4. However, the bottom wall 10 desirably has a slight outward draft, extending outwardly at a slight angle, for example, of approximately 5° beyond perpendicular to the back leg 11. Likewise, the front leg 12 has a slight inward draft, extending at a slight angle, for example, of approximately 3° toward the back leg 11. The slight inward draft of the front leg 12 has the advantage that when the J-channel member 8 is fitted to a radius, the front leg 12 tends to flex further inwardly as shown in phantom lines in FIG. 4 which causes the inturned annular lip 16 to press against the front face of the siding 2 received in the J-channel member 8 as schematically shown in FIG. 2, thereby helping to hold the siding down and enhancing the overall appearance of the joint. Also, such inward flexing of the front leg allows one J-channel member profile to fit different siding thicknesses.

Although the dimensions of the J-channel member 8 of the present invention may vary, in one form of the invention, the J-channel member has a typical wall thickness of approximately 0.040 inch, the channel bottom wall 10 a width of approximately 0.875 inch, the rear leg 11 an overall height of approximately 2.374 inch and the front leg 12 an overall height of approximately 0.765 inch or approximately one-third the height of the back leg 11. The inturned annular lip 16 has a radius of approximately 0.125 inch and an overall height of approximately 0.187 inch. Also, the back leg 12 has a first outward step 23 extending generally perpendicular to the plane of the back leg for a distance of approximately 0.125 inch approximately ½ inch from the outer end of the back leg and a second outward step 24 extending at an angle from the plane of the back leg for a depth of approximately 0.062 inch over a length of approximately 0.062 inch at a distance of approximately 1.642 inches from the outer end of the back leg. Furthermore, each of the slots 19 in the nailing tabs 18 may be located, for example, approximately ¼ inch from the outer ends of the nailing tabs and have a length of approximately ½ inch and a width of approximately 0.156 inch.

From the foregoing, it will now be apparent that the J-channel member of the present invention has excellent formability around radiused openings and does not require any cutting or caulking during installation. Moreover, the J-channel member insures a snug fit against the sheathing and nailing flange of a window, door or louver frame surrounding the opening, and also securely hugs the ends of the siding to aid in holding the siding down and enhance the overall appearance.

Although the invention has been shown and described with respect to a certain preferred embodiment, it is obvious that equivalent alterations and modifications will occur to others skilled in the art upon the reading and understanding of the specification. The present invention includes all such equivalent alterations and modifications, and is limited only by the scope of the claims.

What is claimed is:

1. A J-channel member comprising a channel bottom wall having front and back legs extending in the same general direction from opposite edges of said bottom wall, said back leg being longer than said front leg, said back leg and said bottom wall being made of a relatively rigid plastic material, with slits along the length of said back leg to permit bending of said bottom wall around a radius, and said front leg being made of a relatively flexible plastic material to permit stretching of said front leg during such bending of said bottom wall around a radius.

2. The J-channel member of claim 1 wherein said slits in said back leg are approximately 2 inches apart.

3. The J-channel member of claim 1 wherein said front leg is approximately one-third the length of said back leg.

4. The J-channel member of claim 1 wherein said back leg is stepped along its length to provide a relatively snug fit with a stepped mounting surface.

5. The J-channel member of claim 1 wherein said bottom wall and front and back legs comprise a one piece plastic extrusion.

6. The J-channel member of claim 1 wherein said slits in said back leg extend the full height of said back leg.

7. The J-channel member of claim 6 further comprising a rounded edge joining said back leg to said bottom wall, said slits also extending into said bottom wall to the extent of said rounded edge.

8. The J-channel member of claim 1 wherein said slits in said back leg divide said back leg into a plurality of nailing tabs.

9. The J-channel member of claim 8 further comprising a nailing slot in each of said nailing tabs, said nailing slots being located outwardly of said front leg.

10. The J-channel member of claim 1 further comprising an inturned annular lip at the outer end of said front leg.

11. The J-channel member of claim 10 wherein said front leg extends at a slight angle toward said back leg when said bottom wall is generally straight, whereby when said bottom wall is bent around a radius, said inturned annular lip is flexed further inwardly toward said back leg, thus allowing one J-channel member profile to fit different siding thicknesses.

12. The J-channel member of claim 1 wherein said back and front legs are generally parallel to each other and generally perpendicular to said bottom wall.

13. The J-channel member of claim 12 wherein said front leg has a slight inward draft relative to said back leg when said bottom wall is generally straight.

14. The J-channel member of claim 13 wherein said front leg extends at an angle of approximately 3° toward said back leg when said bottom wall is generally straight.

15. The J-channel member of claim 12 wherein said bottom wall has a slight outward draft relative to said back leg.

16. The J-channel member of claim 15 wherein said bottom wall extends away from said back leg at an angle of approximately 5° from the perpendicular.

17. In combination with a building structure having exterior sheathing, a radiused opening in said sheathing surrounded by a frame member, and exterior siding covering said sheathing, said siding having trimmed end portions around said frame member to provide a clearance space therebetween, a J-channel member fitted around said frame member for receipt of the trimmed end portions of said siding, said J-channel member comprising a bottom wall having front and back legs extending in the same general direction from opposite edges of said bottom wall, said back leg being longer than said front leg for ease of attachment of said back leg to said exterior sheathing, said back leg and bottom wall being made of a relatively rigid plastic material, said back leg having slits along the length thereof to permit bending of said bottom wall to fit said frame member, and said front leg being made of a relatively flexible plastic material to permit stretching of said front leg during such bending of said bottom wall.

18. The combination of claim 17 wherein said J-channel member is a one piece plastic extrusion made of an ultraviolet and weather-resistant plastic for long life.

19. The combination of claim 17 wherein said frame member has a nailing flange extending radially outwardly therefrom to facilitate attachment of said frame member to said exterior sheathing, and said back leg of said J-channel member is stepped along its height to provide a relatively snug fit against said exterior sheathing and nailing flange.

20. The combination of claim 19 wherein said slits in said back leg divide said back leg into a plurality of nailing tabs each having nailing points therein located radially outwardly of said nailing flange on said frame member.

21. The combination of claim 20 wherein said slits in said back leg also extend a portion of the width of said bottom wall, and a bead of sealant is applied to a corner of said frame member which receives the edge of said bottom wall to which said back leg is connected to ensure that said slits are sealed at said corner.

22. The combination of claim 17 wherein said back and front legs extend in a direction generally parallel to each other and generally perpendicular to said bottom wall.

23. The combination of claim 22 wherein said front leg has a slight inward draft relative to said back leg when said bottom wall is relatively straight, whereby when said bottom wall is bent to fit said frame member, the outer end of said front leg is forced radially inwardly against said siding to hold said siding down and allow one J-channel member profile to fit different siding thicknesses.

24. The combination of claim 23 further comprising an inturned annular lip at the outer end of said front leg.

25. The combination of claim 17 wherein said slits in said back leg divide said back leg into a plurality of nailing tabs.

26. The combination of claim 25 further comprising a nailing slot in each of said nailing tabs, said nailing slots being located outwardly beyond the outer end of said front leg.

27. The combination of claim 25 wherein said slits in said back leg extend the full height of said back leg.

28. The combination of claim 27 wherein said slits in said back leg also extend a portion of the width of said bottom wall.

* * * * *